US007080919B2

(12) United States Patent
Gharabegian

(10) Patent No.: US 7,080,919 B2
(45) Date of Patent: Jul. 25, 2006

(54) VIEW AND GLOW SEATING

(75) Inventor: Armen Sevada Gharabegian, Glendale, CA (US)

(73) Assignee: Ethos Design, Glendale, CA (US)

( * ) Notice: Subject to any disclaimer, the term of this patent is extended or adjusted under 35 U.S.C. 154(b) by 73 days.

(21) Appl. No.: 10/973,905

(22) Filed: Oct. 25, 2004

(65) Prior Publication Data

US 2006/0087848 A1 Apr. 27, 2006

(51) Int. Cl.
*F21V 33/00* (2006.01)

(52) U.S. Cl. ..... 362/127; 362/131; 362/253; 362/294; 362/373; 297/217.6

(58) Field of Classification Search ..... 362/127, 362/131, 253, 294, 373, 234, 483; 353/57, 353/61; 297/217.6
See application file for complete search history.

(56) References Cited

U.S. PATENT DOCUMENTS 2,635,681 A * 4/1953 Hiltman et al. ..... 297/217.6
3,506,820 A * 4/1970 Shannon ..... 362/131
4,217,628 A * 8/1980 Windom ..... 362/483
5,329,716 A * 7/1994 Fite ..... 40/575
6,164,787 A * 12/2000 Seki et al. ..... 362/1
6,871,696 B1 * 3/2005 Aoki et al. ..... 165/43
2005/0201080 A1 * 9/2005 Seward ..... 362/97

* cited by examiner

*Primary Examiner*—Thomas M Sember
(74) *Attorney, Agent, or Firm*—Pillsbury Winthrop Shaw Pittman LLP

(57) ABSTRACT

Seating structures having (1) an internal image projector for projecting images on the exterior surface of such seating structures and (2) an internal source of illumination with color changing capability, the effect of which is visible on the exterior surface of the seating structures are disclosed.

The image projection technology is powered by a standard AC outlet and operated by remote control. The illumination technology is powered by either an AC outlet or battery and is operated by remote control. An internal or external DVD or other data source may be incorporated for image projection.

The housing of the projection source provides maximum image throw and quality. The internal construction of the seating structure achieves high-quality projected images and maintains comfortable sitting conditions. The housing of the internal light source achieves a high-impact lighting effect. Mini-coolant fans mounted in the seating structure maintain a low temperature within the seating structures.

37 Claims, 1 Drawing Sheet

VIEW AND GLOW SEATING

BACKGROUND

1. Technical Field

Embodiments described herein are directed to seating structures that incorporate an internal image projection and an internal source of illumination.

2. Related Art

Many professionals such as, for example, event planners, exhibitors, hospitality professionals, and retail designers, employ furniture-rental as a key business activity. A lack of unique, high-quality designs available in the furniture-rental market causes industry professionals to reuse the same rental items, miss the opportunity to differentiate themselves from their competitors, and disappoint their clients by producing stale results. The embodiments described herein aim to compensate for the lack of outstanding, inventive, and unique furniture design currently available in the marketplace.

SUMMARY OF TECHNICAL FIELD

Embodiments described herein aim to compensate for the dearth of superior and distinctive furniture design currently available in the stream of commerce. The principle object of the present invention is to incorporate non-traditional visual stimuli into the design of seating structures such as, for example, chairs, sofas, and ottomans. Another object of this invention is to incorporate an internal source of projected images visible on the exterior surface of such seating structures ("VIEW"). An additional object of the present invention is to incorporate an internal source of illumination, with color changing capability, the effect of which is visible on the exterior surface of the seating structures ("GLOW").

The seating surfaces of the present invention feature internally housed projection or illumination technologies. For illustration purposes, the upholstered surface of the seating may include a rigid or flexible, semi-opaque material, to maximize the VIEW or GLOW effects.

VIEW technologies may be powered by a standard AC outlet and be operated by remote control. The GLOW technologies may be powered by either an AC outlet or battery and be operated by remote control. An internal or external DVD or other data source may be incorporated into the invention to enable the VIEW technology.

The housing of the projection source within the seating is engineered for maximum image throw and quality. The internal construction of the seat, along with the selection of materials for the seat-back, function in concert to achieve a high-quality projected image and to maintain comfortable sitting conditions. The housing of the internal light source, along with the interior construction of the seating and selection of materials for the seat cushion and seat-back, function in concert to achieve a high-impact lighting effect. A feature of the invention includes the application of mini-coolant fans mounted in the back or bottom panel of the seating, the purpose of which is to maintain a low temperature within the interior of the seating surface. The foregoing objects, features, and advantages, as well as others, will become more apparent in light of the following detailed description read with reference to the drawing.

BRIEF DESCRIPTION OF THE DRAWING

A detailed description of embodiments of the invention will be made with reference to the accompanying drawing.

DETAILED DESCRIPTION

Figure 1:
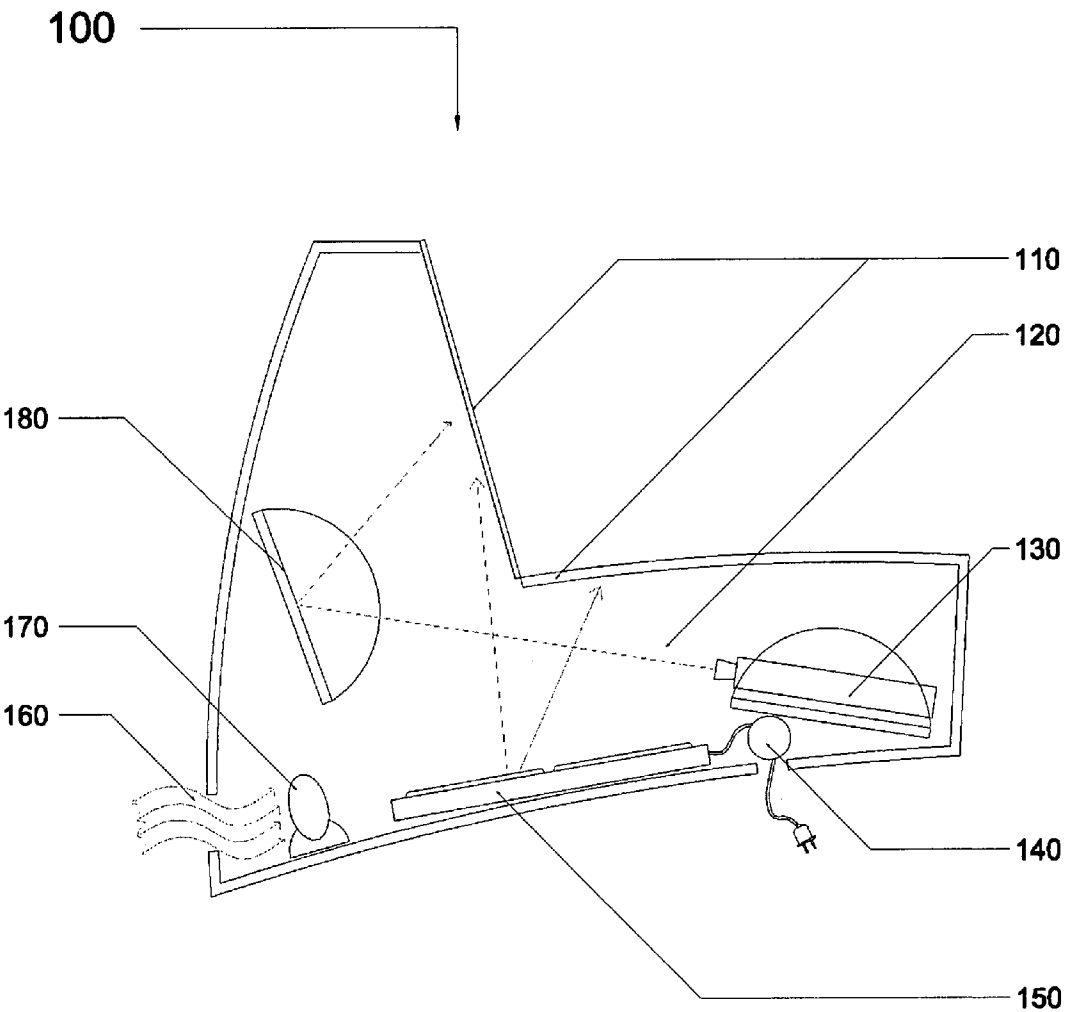
FIG. 1 is a perspective view of a seating structure having an internal image projector and an internal source of illumination, according to an embodiment of the present invention.

The following paragraphs describe view and glow seating structures that incorporate an internal image projection and an internal source of illumination. The seating structures incorporate a moving or a static image via projection. In addition, the seating structures have an internal source of illumination that allows the exterior surface of the seating structures to glow. Referring to FIG. 1, a seating structure 100 is shown. The seating structure 100 is primarily used for sitting, lounging, and resting. The seating structure 100 may be a sofa, sofa bed, chair, ottoman, chaise longue, recliner, dining chair, cushion, pillow, or an inflatable for outdoor use, for example. The seating structure 100 may be air-pressured or vacuum-formed amorphous shapes. Furthermore, the seating structure 100 may have one or more seats.

The seating structure 100 does not have to conform to a normative furniture function. The seating structure 100 can instead be a series of soft glowing spheres on a horizontal surface or multiple cubes, rectangles, or pillows, for example, arranged in a specific pattern, with a design intent, or with the intention of creating some form of lounge, seating, sleeping, or resting surface or surfaces that can be joined together.

The seating structure 100 may be constructed of various materials but is not limited to a substructure or an internal structure. Internal structures may be constructed of different types of wood, plywood, high density wood, and fibrous wood of various types. The seating structure 100 may be constructed of steel, aluminum, brass, or copper, for example. The seating structure 100 may further be cast in various materials such as plastic, acrylic, or corrugated acrylics such as polygal, for example.

The seating structure 100 consists of a light penetrable surface 110 that captures projection output or illumination. Examples of such light penetrable surfaces 110 that capture projection output include, but are not limited to, acrylic, plastic, and fabric. Examples of such light penetrable surfaces 110 that capture illumination include, but are not limited to, translucent foam, translucent rubber, and inflatables. Indeed, the light penetrable surface 110 may be any material through which images and light can pass. The light penetrable surface 110 of the seating structure 100 can be soft or hard. Moreover, the light penetrable surface 110 can be various types of rubber, neoprene, lexan, vinyl, polypropylene, polyurethane, or latex-all in various degrees of density. The light penetrable surface 110 of the seating structure 100 may further be created using injection molded plastics, cast acrylic, and fiber glass, which can be semi-translucent or transparent.

The seating structure 100 need not be horizontal. Instead, it can have angles, be skewed, flat, concave, or convex. The same holds true for the seat-back, provided that the seating structure 100 has such a seat-back. The seating structure 100 can be comprised of many glowing pieces, such as for example, balls of light or cubes of light that may be soft or hard. The seating structure 100 may have pillows that are inflated or are filled with foam or other type of substrate or fibrous materials such as polyester. Pellets of foam, rubber pellets, and transparent or translucent tubes, all of which may glow, may be included in the seating structure 100. Moreover, the light penetrable surface 110 of the seating structure 100 can be constructed with the use of fiber optic lights or a type of fabric that inherently glows.

The light penetrable surface 110 of the seating structure 100 may have fabric attached to an inflatable, stretch fabric, such as for example, lycra, textured fabrics, foam with no fabric, fiber glass, or rubber of various types and densities, such as latex, a stretchable rubber. Semi-opaque foam or acrylic may be used as well.

Inside the seating structure 100 is a chamber 120 that houses a projection mechanism 130, such as but not limited to a single projector, multiple projectors, image sources such as mirrors or prisms, and various types of light instruments that are capable of throwing images and patterns. The projection mechanism 130 may be mounted with a bracket to allow for adjusting the resulting projection angle. Projection may occur in one area of the seating structure 100 or in various areas such as, for example, horizontal and vertical surfaces including, but not limited to, the seat, the seat-back, and inside pillows.

A retractable cable 140 is used for plugging the seating structure 100 into an AC electrical outlet. The retractable cable 140 provides the added benefit of moving the seating structure 100 in various positions throughout a room while only displaying as much of the cord of the retractable cable 140 as necessary. In an alternative embodiment, the seating structure 100 may also be battery operated.

The seating structure 100 has an internal mechanism that affects a glow using various types of light sources 150 such as but not limited to different types of fluorescent lights, different types of incandescent lights, white light emitting diodes ("LEDs"), colored LEDs, LEDs that have color changing capabilities through remote control, tube lights, xenon lights, phosphorous tubes of light through chemical reaction, fiber optics, strobe lights, image projectors, or moving light sources that cause the light objects to glow. Light stemming from within the seating structure 100, through the seating structure 100, or as inherently being a part of the fiber of the seating structure 100, may change color via various types of manipulation such as different colored light bulbs, color changing light sources, color changing light bulbs, light gels, glass gobos, or transparencies, such as slides.

A feature of the invention includes the application of one or more mini-coolant fans 170 mounted in the back or bottom panel of the seating structure 100. The mini-coolant fans 170 maintain a low temperature within the interior of the seating structure 100 and generate the circulation of air. Ventilation 160 is provided to enable the air circulation from the mini-coolant fans 170.

The interior of the seating structure 100 incorporates a reflective surface 180 that captures images from the projection mechanism 130 and projects such images to a desired surface. The reflective surface 180 aids in magnification and correction of image sources such as mirrors, prisms, or other materials, including but not limited to clear acetate or reflective acetate. Internal or external cameras are used to record and playback real time movement with respect to the image projection.

The seating structure 100 may further house an audio source incorporated within the glowing function. In addition, the seating structure 100 may have an external light source or be designed within channels to emit light onto the seating structure. An audio-video source may further be housed within the seating structure 100. DVD players, laptop computers, or an Internet source of image projection may be included. Finally, the seating structure 100 may also have an external source for projection such as a DVD player. The seating structure 100 may operate with a remote control.

While the above description refers to particular embodiments of the present invention, it will be understood to those of ordinary skill in the art that modifications may be made without departing from the spirit thereof. The accompanying claims are intended to cover any such modifications as would fall within the true scope and spirit of the present invention.

The presently disclosed embodiments are therefore to be considered in all respects as illustrative and not restrictive; the scope of the invention being indicated by the appended claims, rather than the foregoing description. All changes that come within the meaning and range of equivalency of the claims are therefore intended to be embraced therein.

What is claimed is:

1. A system for internal image projection and illumination, comprising:

a seating structure having a light penetrable outer surface;

a chamber housed within the seating structure;

a projection mechanism housed within the chamber that generates images;

at least one light source housed within the chamber;

at least one fan mounted in a back or bottom panel of the seating structure;

a ventilation area; and a reflective surface within the seating structure that captures images from the projection mechanism and projects such images to a desired surface of the seating structure.

2. The system of claim 1, wherein the seating structure is one of a sofa, sofa bed, chair, ottoman, chaise longue, and a recliner.

3. The system of claim 1, wherein the light penetrable surface captures projection output from the projection mechanism.

4. The system of claim 3, wherein the light penetrable surface is formed from one of the group of acrylic, plastic, and fabric.

5. The system of claim 1, wherein the light penetrable surface captures illumination from the at least one light source.

6. The system of claim 4, wherein the light penetrable surface is formed from one of the group of translucent foam, translucent rubber, and inflatables.

7. The system of claim 1, wherein the projection mechanism is one of an image source and one or more projectors.

8. The system of claim 7, wherein the image source is a mirror.

9. The system of claim 7, wherein the image source is a prism.

10. The system of claim 1, wherein the projection mechanism is mounted to the seating structure with a bracket to allow for angle adjustment.

11. The system of claim 1, wherein the at least one light source is from one of the group of fluorescent lights, incandescent lights, white light emitting diodes, colored light emitting diodes, light emitting diodes with color changing capability, xenon lights, fiber optics, strobe lights, and phosphorous tubes of light.

12. The system of claim 1, wherein the at least one fan is a mini-coolant fan employed to maintain a low temperature within the interior of the seating structure and to generate air circulation.

13. The system of claim 12, wherein the ventilation area enables the air circulation generated by the at least one mini-coolant fan.

14. The system of claim 1, wherein the reflective surface aids in magnification and correction of images and is one of a mirror, prism, clear acetate, and reflective acetate.

15. A seating structure of internal illumination, comprising:

one or more light sources housed within a chamber of the seating structure to project light;

a light penetrable outer surface covering the seating structure to capture illumination from the light projected by the one or more light sources, the light penetrable outer surface being upholstery for the seating structure;

one or more fans mounted in a back or bottom panel of the seating structure; and a ventilation area in the seating structure to ventilate air moved by the one or more fans.

16. The seating structure of internal illumination of claim 15, wherein the seating structure is selected from one of a group of a sofa, a sofa bed, a chair an ottoman, a chaise lounge, and a recliner.

17. The seating structure of internal illumination of claim 15, wherein the light penetrable surface is comprised of one of the group of foam, rubber, neoprene, lexan, vinyl, polypropylene, polyurethane, latex, acrylic, fiber glass, and injection molded plastics.

18. The seating structure of internal illumination of claim 15, wherein the one or more light sources are selected from one of the group of fluorescent lights, incandescent lights, white light emitting diodes, colored light emitting diodes, light emitting diodes with color changing capability, tube lights, xenon lights, fiber optics, strobe lights, and phosphorous tubes of light.

19. The seating structure of internal illumination of claim 18, wherein the one or more light sources are battery powered.

20. The seating structure of internal illumination of claim 18, wherein the one or more light sources are powered through an electrical alternating current outlet via a retractable cable.

21. The seating structure of internal illumination of claim 18, wherein the one or more light sources are operated by remote control.

22. The seating structure of internal illumination of claim 15, wherein the one or more fans are utilized to maintain a low temperature with the interior of the seating structure and to generate air circulation.

23. A seating structure of internal image projection, comprising:

a light penetrable outer surface to capture projection output;

at least one projection mechanism housed within a chamber of the seating structure to generate images;

at least one fan mounted in the seating structure;

a ventilation area; and a reflective surface within the seating structure that captures images from the at least one projection mechanism and projects such images to a desired surface of the seating structure.

24. The seating structure of internal image projection of claim 23, wherein the seating structure is one of a sofa, sofa bed, chair, ottoman, chaise longue, and recliner.

25. The seating structure of internal image projection of claim 23, wherein the light penetrable surface captures projection output from the at least one projection mechanism and is comprised of one of the group of acrylic, plastic, and fabric.

26. The seating structure of internal image projection of claim 23, wherein the at least one projection mechanism is an image source.

27. The seating structure of internal image projection of claim 26, wherein the image source is one of a mirror and a prism.

28. The seating structure of internal image projection of claim 23, wherein the at least one projection mechanism is a projector.

29. The seating structure of internal image projection of claim 23, wherein the projection mechanism is mounted to the seating structure with a bracket to allow for angle adjustment.

30. The seating structure of internal image projection of claim 23, wherein the at least one projection mechanism is powered through an electrical alternating current outlet via a retractable cable.

31. The seating structure of internal image projection of claim 30, wherein the at least one projection mechanism is operated by remote control.

32. The seating structure of internal image projection of claim 23, wherein the at least one fan maintains a low temperature within the seating structure and generates air circulation.

33. The seating structure of internal image projection of claim 32, wherein the ventilation area enables the air circulation generated by the at least one fan.

34. The seating structure of internal image projection of claim 23, wherein the reflective surface aids in magnification and correction of images.

35. The seating structure of internal image projection of claim 34, wherein the reflective surface is one of a mirror, prism, clear acetate, and reflective acetate.

36. A seating structure of internal illumination, comprising:

one or more light sources housed within a chamber of the seating structure to project light;

a light penetrable outer surface covering the seating structure to capture illumination from the light projected from one or more light sources; and one or more fans mounted in a back or bottom panel of the seating structure to circulate air within the seating structure and to provide cooling for the one or more light sources.

37. A seating structure of internal illumination, comprising:

one or more light sources housed within a chamber of the seating structure to project light;

a light penetrable outer surface covering the seating structure to capture illumination from the light projected by the one or more light sources, the light penetrable outer surface being a fabric; and one or more fans mounted in a back or bottom panel of the seating structure to provide cooling for the one or more light sources.

* * * * *